US005282761A

United States Patent [19]

Hollingsworth

[11] Patent Number: 5,282,761

[45] Date of Patent: Feb. 1, 1994

[54] TOGGLE CLAMP CONNECTOR

[75] Inventor: Elmont E. Hollingsworth, Austin, Tex.

[73] Assignee: Minnesota Mining and Manufacturing Company, St. Paul, Minn.

[21] Appl. No.: 978,552

[22] Filed: Nov. 19, 1992

[51] Int. Cl.[5] ..... H01R 11/03

[52] U.S. Cl. ..... 439/790; 439/863

[58] Field of Search ..... 439/783, 784, 794, 790, 439/863

[56] References Cited

U.S. PATENT DOCUMENTS

| | | | |
|---|---|---|---|
| 862,082 | 7/1907 | Lewis | 439/790 |
| 4,723,921 | 2/1988 | Pooley | 439/863 X |
| 4,872,856 | 10/1989 | Pooley et al. | 439/863 X |

*Primary Examiner*—Larry I. Schwartz
*Assistant Examiner*—Khiem Nguyen
*Attorney, Agent, or Firm*—Gary L. Griswold; Walter N. Kirn; David W. Anderson

[57] ABSTRACT

A toggle connector for connecting the conductors of two or more wires includes a base and two interconnected leaves which may be forced into an over-toggle position to clamp the conductors to each other.

5 Claims, 2 Drawing Sheets

TOGGLE CLAMP CONNECTOR

FIELD OF THE INVENTION

The present invention relates to connectors for electrically connecting the conductors of two or more wires by clamping the conductors together.

BACKGROUND OF THE INVENTION

Mechanical connectors for electrically connecting the conductors of two or more wires have in the past commonly taken the form of a metal barrel which may be fitted over the conductors and compressed or two clamp halves which may be clamped together by a bolt or other fastener to retain and maintain electrical contact between the conductors. While these connectors serve their intended purposes, a common drawback is that the connectors do not include a means of providing a reserve clamping force which would compensate for movement of the conductors or relaxation of the clamping force by such factors as temperature changes or permanent deformation of the material comprising the conductors or the connector.

It is desired to provide an inexpensive connector which may be easily applied to the conductor portions of wires to provide an electrical connection between the wires and which would include a reserve, spring-type force to compensate for factors which would tend to decrease the force with which the conductors were originally clamped.

SUMMARY OF THE INVENTION

The present invention accomplishes the desirable aspects of an ideal connector described above by providing a toggle clamp connector which comprises a frame including a base having two ends, two substantially parallel upstanding walls attached one to each of the ends of the base, a first toggle leaf having two ends, a second toggle leaf having two ends, and means interconnecting one end of each of the first toggle leaf and the second toggle leaf to produce interconnected ends of the leaves and free ends of the leaves. The first toggle leaf and the second toggle leaf have a combined length greater than the distance remaining between the upstanding walls when the conductors of the at least two wires are located within the toggle clamp connector adjacent the base and substantially parallel to the upstanding walls, so that when the interconnected leaves are located between the upstanding walls, the interconnected ends of the first toggle leaf and the second toggle leaf may be forced toward the base and just beyond the point wherein the first toggle leaf and the second toggle leaf are in line so that the free ends of the leaves clamp and retain the conductors at their locations within the toggle clamp connector adjacent at least one upstanding wall to produce electrical contact between the at least two conductors. The connector of the invention may be used with the conductors of the wires to be connected located at one end of the connector or with individual conductors located at opposite ends of the base. The toggle leaves may be separate pieces and separate from the frame or the connector may be formed from a single strip of material with the frame, upstanding walls and toggle leaves forming different portion of the strip and defined by bends in the material.

BRIEF DESCRIPTION OF THE DRAWINGS

The present invention will be more thoroughly described with respect to the accompanying drawings, wherein like numbers refer to like numbers in the several views, and wherein:

FIGS. 4, 5 and 6 are perspective views of a second embodiment of a toggle clamp connector according to the present invention, wherein FIG. 4 depicts the connector in the fully open position, FIG. 5 depicts the connector in a partially closed position and FIG. 6 depicts the connector in a fully closed position.

DESCRIPTION OF THE PREFERRED EMBODIMENT

Figure 1:
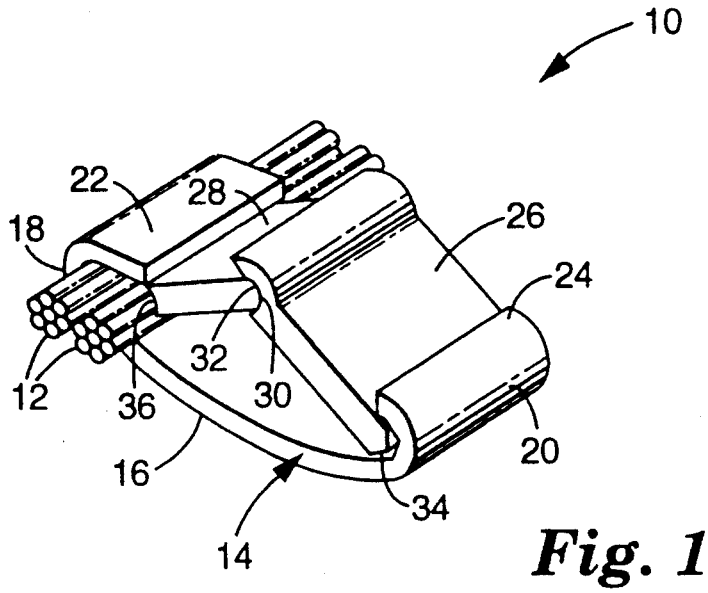
FIGS. 1 and 2 are perspective views of a first embodiment of a toggle clamp connector according to the present invention, with FIG. 1 depicting the connector in an open position and FIG. 2 depicting the connector in a closed position.
Figure 2:
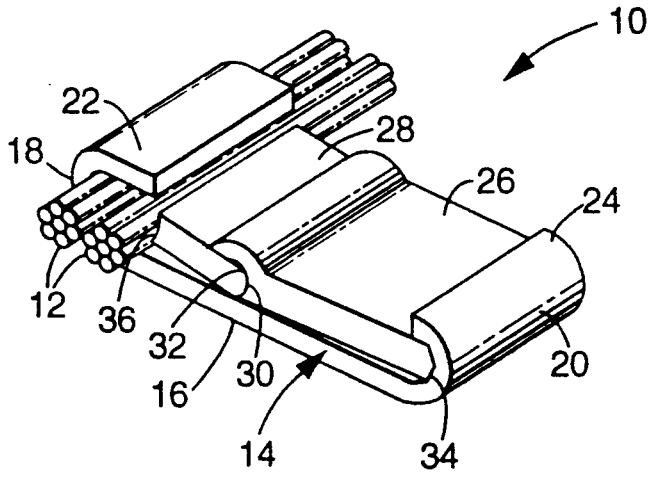

FIGS. 1 and 2 illustrate a toggle clamp connector, generally indicated as 10, which may be used to electrically connect the conductor portions of two or more electrical wires 12. Throughout this discussion, the conductors 12 to be connected are illustrated as being multi-strand conductors, but one or both could be single-strand conductors. Also, although two conductors 12 are illustrated throughout, any number which will fit within the connector 10 may be accommodated.

The connector 12 includes a frame 14 comprised of a base 16 and two upstanding walls 18 and 20 extending from the ends of the base 16. The upstanding walls 18 and 20 preferably terminate in inwardly directed ends 22 and 24 which are intended to prevent the conductors 12, or other parts of the connector 10 from escaping the frame 14.

The connector 10 also includes a first toggle clamp leaf 26 and a second toggle clamp leaf 28. These leaves 26 and 28 are arranged in end-to-end fashion to define interconnected ends 30 and 32, and free ends 34 and 36. The combined length of the toggle clamp leaves 26 and 28 is longer than the distance remaining within the frame 14 after the conductors 12 have been inserted, so that the leaves must be angled relative to each other to be inserted between one of the upstanding walls 20 and the conductors 12, as illustrated in FIG. 1. To close the connector 10, the interconnected ends 30 and 32 of the toggle clamp leaves 26 and 28 are forced toward the base 16 of the frame 14 until the leaves 26 and 28 touch the base 16. This movement of the leaves 26 and 28 may be accomplished by hand, if the connector 10 is small in size, or with the aid of a tool such a hammer or pliers.

The force necessary to collapse the toggle clamp leaves 26 and 28 is directed and multiplied outwardly toward the upstanding wall 20 and the conductors 12. This multiplied force tightly clamps the conductors to each other and the upstanding wall 18 and so results in good electrical contact between the conductors 12. The clamping force of the leaves 26 and 28 also causes resilient deformation of the frame 14. This deformation is desirable because it provides a reserve "spring" force which will serve to accommodate any slippage of the conductors 12 relative to each other or dimensional changes of the conductors 12 or the connector 10 which may result from such things as temperature changes or deformation of materials. FIG. 1 illustrates that the base 16 is formed so that the base 16 is curved when the clamp is in the relaxed state. It is seen in FIG. 2 that the force of closing the connector 10 causes the base 16 to straighten out. This straightening of the base 16 provides a portion of the spring reserve discussed above. The curve of the base 16 is not necessary as the closure force would deform the connector 12 at other locations to produce the spring reserve force, but curving the base 16 allows greater control over the location of deformation and the final shape of the connector 10 when closed.

As may be seen in FIG. 2, the interconnected ends 30 and 32 of the leaves 26 and 28 go beyond a position parallel to the base 16 and in line with each other to achieve a so-called "over-toggle" condition. This condition is achieved because the leaves 26 and 28 go beyond a point wherein the leaves are in line with each other. This is indicated by the fact that the free ends 34 and 36 of the leaves 26 and 28 are further away from the base 16 than are the interconnected ends 30 and 32 when the connector 10 is closed. The leaves 26 and 28 are depressed to a point wherein the interconnected ends 30 and 32 touch the frame 14.

Because of this over-toggle condition, and the fact that residual spring forces are present in the closed connector 10, the interconnected ends 30 and 32 of the leaves 26 and 28 will be constantly forced toward the base 16 and thus the connector 10 will remain closed once that condition is achieved.

A detail of the connector 10 is that the interconnected ends 30 and 32 are formed to interlock, with the end 30 being rounded and the end 32 having a socket to accommodate the rounded end 30. This construction will prevent the interconnected ends 30 and 32 from disengaging when the connector 10 is closed. Other details are that the free end 36 of the leaf 28 which contacts the conductors 12 is shaped to conform to the conductors 12 and the free end 34 of the leaf 26 is pointed to engage the upstanding wall 20 positively and precisely locate the end 34 of the leaf 26 relative to the wall 20.

Figure 3:
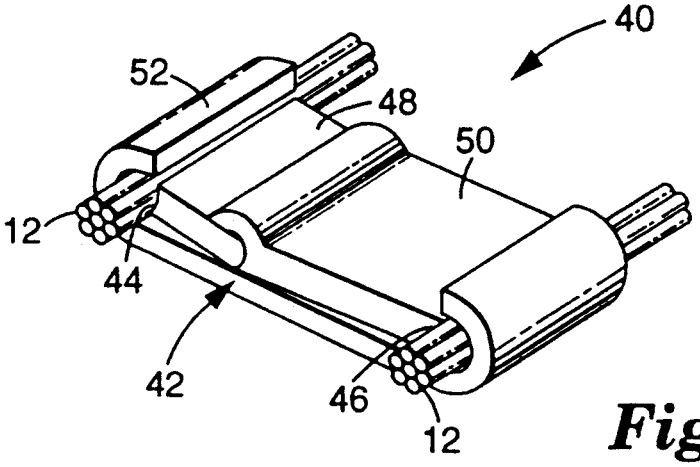
FIG. 3 is a perspective view of an alternate embodiment of a toggle clamp connector according to the invention.

FIG. 3 illustrates a second embodiment of a toggle clamp connector 40 which is designed to accommodate conductors 12 in a slightly different manner than the embodiment of FIGS. 1 and 2. The connector 40 accommodates conductors 12 located at each end of the base 42 rather than grouped together at one end. Electricity must flow through the length of the connector 40, so this embodiment is not as preferred as the embodiment of FIGS. 1 and 2, but the connector 40 may offer some advantages such a space savings in certain situations.

The connector 40 is identical to the connector 10 except each free end 44 and 46 of the leaves 48 and 50 is formed to conform to the shape of the conductors 12, and the inwardly directed end of the upstanding arm 52 is shortened since only one conductor rather than two need be accommodated.

Figure 4:
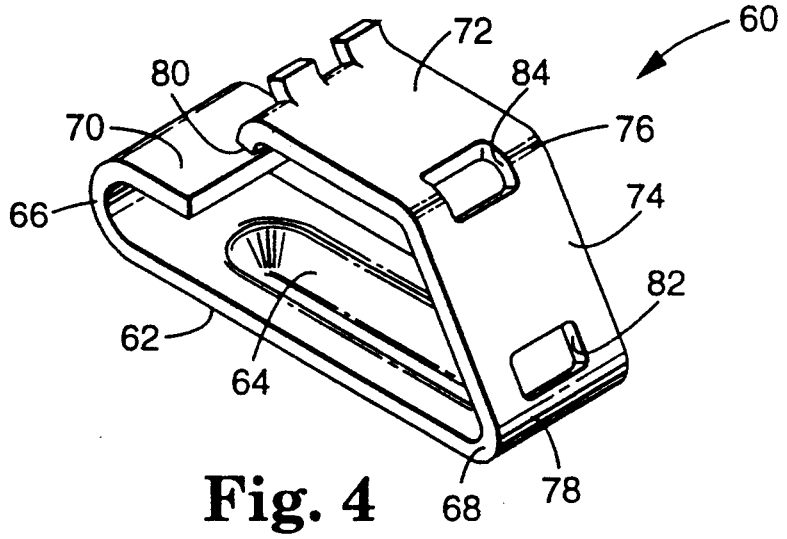
Figure 5:
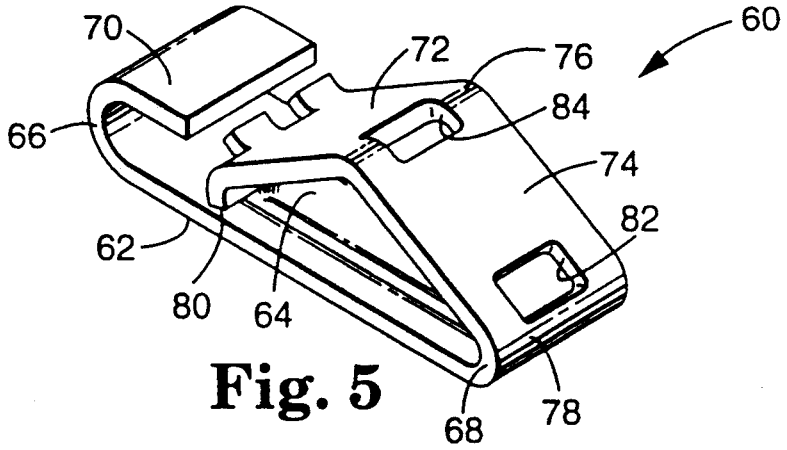
Figure 6:
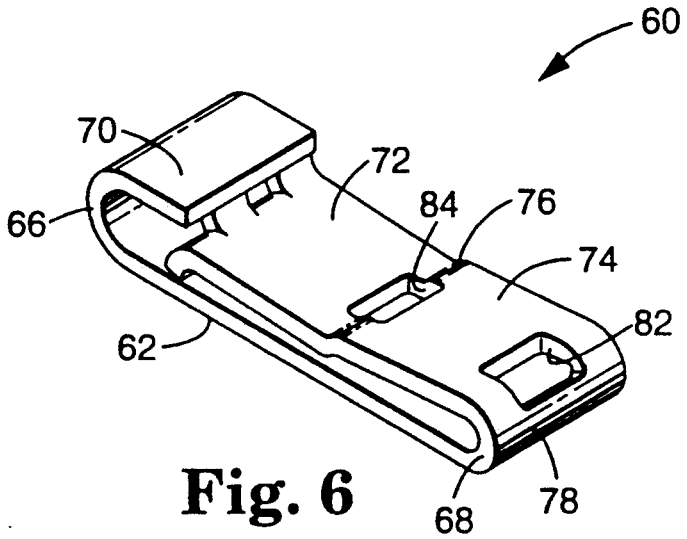

FIGS. 4 through 6 illustrate a third embodiment of a toggle clamp connector 60 which is formed of a single strip of material rather than discrete pieces. However, all elements described thusfar with reference to the connectors 10 and 40 are present in the connector 60 and operate in a substantially identical manner. The difference being that bends in the strip of material define the parts which are separate in the prior embodiments.

The connector 60 includes a base 62 which is formed with a centered, longitudinal rib 64 for stiffness. More than one rib 64 may be provided, and the rib or ribs 64 need not coincide with the centerline of the base 62. The base extends to upstanding walls 66 and 68 like the embodiment of FIGS. 1, 2 and 3. One of the upstanding walls 66 terminates in an inwardly directed end 70 which is spaced from the base 62 a distance sufficient to accommodate the conductors (not shown) of wires to be electrically connected by the connector 60. The inwardly directed wall extends a distance sufficient to capture the conductors to be placed within the connector 60.

Above the base 62 are two toggle clamp leaves 72 and 74 defined by a first bend 76 in the material comprising the connector 60. The first bend 76 is thus the interconnected ends 30 and 32 of the embodiment of the connector of FIG. 1, 2 and 3, except that the ends are interconnected at a bend 76 in the material rather than at a socket as previously described.

The interconnected leaves 72 and 74 are attached to the upstanding wall 68 at a second bend 78 in the material comprising the connector 60. This second bend 78 is formed at the upper end of the upstanding wall 68. The bend in the material of the connector 60 forming the upstanding wall 68 and the second bend 78 may be combined into one smooth bend as shown in FIGS. 4–6 or may be two discrete bends.

FIGS. 5 and 6 illustrate the steps in completing a connection utilizing the connector 60. Once the conductors are inserted adjacent and parallel to each other within the inwardly directed wall 70, the interconnected leaves 72 and 74 are bent downwardly at the second bend 78 until the free end 80 of the interconnected leaf 72 contacts the base 62 as shown in FIG. 5. Bending of the connector may be accomplished either by hand, or, if the size of the connector 60 requires, a tool such as a pliers or a hammer. Continued force applied to the interconnected leaves 72 and 74, preferably at the first bend 76, causes the first bend 76 to pass the toggle position wherein the leaves 72 and 74 are in line and assume the "over-toggle" position described above. This position firmly and reliably clamps the conductors of two or more wires together in electrical contact. To reliably produce this over-toggle condition, it is desirable that the leaves 72 and 74 go a reasonable and definite distance beyond the position where they are in line. This is accomplished by maintaining the end of the toggle leaf 74 (at the second bend 78) a distance above the base 62.

To accomplish this, the connector 60 is provided with a hole 82 in the vicinity of the second bend 78. This hole 82 produces a local weakening of the material of the connector 60 and encourages bending to take place at the second bend 78. Where it not for this weakening hole 82, the connector 60 might fold sharply at the end adjacent the second bend 78. Such a fold might not allow the leaves 72 and 74 to achieve or go beyond the in line position and thus prevent attainment of the over-toggle condition necessary for reliable clamping of the connector 60 to the conductors which are to be joined.

For a similar reason the connector 60 is furnished with another hole 84 at the location of the first bend 76. Provision of this hole 84 encourages the material of the connector 60 to bend at the first bend 76 rather than some other point.

Clamping is achieved because movement of the leaves 72 and 74 to the clamp position stresses the material of the connector 60 and stores potential energy in the resiliency of the material which acts to maintain the conductors in contact despite such things as movement or compression of the conductors.

The material comprising the connectors 10, 40 or 60 may be any electrically conductive and resilient material, preferably a metal, and more preferably a metal such as stainless steel, phosphor bronze or copper. Except for the embodiment of FIG. 3 wherein either the base 42 or the leaves 48 and 50 must conduct electricity from one conductor to another, the components of the connectors 10 or 60 could be non-metal, resilient materials, such as plastic.

Although the invention has been described herein as being used to electrically connect the conductors of electrical wires, it should be recognized that the invention is equally useful as a clamp only. For example, the connector of the invention could be use to clamp together ropes or metal cable, either separate pieces to one another or one end of a rope or cable to itself to form a loop.

Finally, any embodiment of the connector 10, 40 or 60 may be opened by inserting a tool such as a pry bar, lever or screw driver point between the base and the interconnected leaves and forcing the leaves away from the base.

I claim:

1. A toggle clamp connector formed of a single folded piece of material and adapted for electrically connecting the conductors of at least two wires, said toggle clamp connector comprising:

a frame including a base having two ends, a first upstanding wall attached to one of said ends of said base and extending substantially perpendicularly from said base, and a second upstanding wall attached to the other of said ends of said base and extending substantially perpendicularly from said base in the same direction as the extension of said first upstanding wall from said base;

a first toggle leaf having two ends;

a second toggle leaf having two ends;

a first bend in said material connecting one end of each of said first toggle leaf and said second toggle leaf to produce interconnected ends of said leaves and free ends of said leaves;

a second bend connecting said free end of said second toggle leaf to said second upstanding wall;

said first toggle leaf and said second toggle leaf having a combined length greater than the distance remaining between said upstanding walls when the conductors of the at least two wires are located within said toggle clamp connector adjacent said first upstanding wall and substantially parallel to said upstanding walls; wherein with said interconnected toggle leaves disposed within said frame between said upstanding walls, said interconnected ends of said first toggle leaf and said second toggle leaf may be forced toward said base and beyond a position wherein said first toggle leaf and said second toggle leaf are parallel to each other so that said free end of said first toggle leaf clamps and retains the conductors in contact with each other at said first upstanding wall to produce electrical contact between the at least two conductors.

2. A toggle clamp connector according to claim 1 wherein said free end of said first toggle leaf includes portions bent in opposite directions from said first toggle leaf to increase the area of said first toggle leaf in contact with the conductors.

3. A toggle clamp connector according to claim 1 further including a containment wall extending from said first upstanding wall, said containment wall being spaced from and substantially parallel to said base to extend over said base and contain the conductors between said containment wall and said base.

4. A toggle clamp connector according to claim 1 further including a hole near said first bend which allows insertion of a tool to lift said first and said second toggle leaves away from said base and thereby open said toggle clamp connector.

5. A toggle clamp connector according to claim 1 further including a stiffening rib in said base.

* * * * *